US007318707B2

(12) United States Patent
Scharffenberger

(10) Patent No.: US 7,318,707 B2
(45) Date of Patent: Jan. 15, 2008

(54) SUPPORT BEARING FOR A VERTICALLY ARRANGED CENTRIFUGAL PUMP

(75) Inventor: Wolfgang Scharffenberger, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 442 days.

(21) Appl. No.: 11/095,617

(22) Filed: Apr. 1, 2005

(65) Prior Publication Data

US 2005/0232794 A1 Oct. 20, 2005

Related U.S. Application Data

(63) Continuation of application No. PCT/EP03/08919, filed on Aug. 12, 2003.

(30) Foreign Application Priority Data

Oct. 2, 2002 (DE) ..... 102 45 957

(51) Int. Cl.
*F04B 17/03* (2006.01)
*F01D 11/00* (2006.01)
*F03B 11/06* (2006.01)

(52) U.S. Cl. ..... 417/423.13; 417/424.1; 415/111; 415/180

(58) Field of Classification Search ..... 417/423.13, 417/424.1; 415/111, 112, 175, 180
See application file for complete search history.

(56) References Cited

U.S. PATENT DOCUMENTS

| | | | | |
|---|---|---|---|---|
| 3,171,355 | A * | 3/1965 | Harris et al. | 417/365 |
| 3,220,352 | A | 11/1965 | Smith et al. | |
| 3,482,522 | A | 12/1969 | Baker et al. | |
| 4,234,290 | A | 11/1980 | Lobach et al. | |
| 5,413,459 | A | 5/1995 | Woodall et al. | |
| 5,961,301 | A * | 10/1999 | Wasserman et al. | 417/420 |

FOREIGN PATENT DOCUMENTS

| | | |
|---|---|---|
| DE | 1279471 | 10/1968 |

* cited by examiner

*Primary Examiner*—Charles G Freay
(74) *Attorney, Agent, or Firm*—Crowell & Moring LLP

(57) ABSTRACT

A vertical centrifugal pump having a support bearing arranged above the pump and including an axial bearing (22) and a radial bearing (23). A housing (24) encasing the support bearing (22, 23) is directly connected to the flow-carrying housing (25) of the centrifugal pump. Lubrication, and optionally cooling, of the support bearing (22, 23) are performed by the pumped medium, which is conveyed to the support bearing (22, 23) through a connection leading from the pressure zone (28) of the flow-carrying housing and is discharged into the suction zone (29) of the pump, and a pump shaft seal (31) is disposed on the opposite side of the support bearing (22, 23) from the flow-carrying housing of the centrifugal pump.

3 Claims, 3 Drawing Sheets

SUPPORT BEARING FOR A VERTICALLY ARRANGED CENTRIFUGAL PUMP

CROSS REFERENCE TO RELATED APPLICATIONS

This application is a continuation of international application no. PCT/EP2003/008919, filed Aug. 12, 2003, designating the United States of America, and published in German as WO 2004/033918 on Apr. 22, 2004, the entire disclosure of which is incorporated by reference herein. Priority is claimed based on Federal Republic of Germany patent application no. DE 102 45 957.6, filed Oct. 2, 2002.

BACKGROUND OF THE INVENTION

The present invention relates to a vertically arranged centrifugal pump with a support bearing which is provided above the pump and absorbs the axial and radial forces exerted by the centrifugal pump and which is lubricated and, optionally, cooled by a medium conducted via the support bearing, the centrifugal pump being driven via a shaft which is extended through a housing surrounding the support bearing and into a housing or housing part belonging to the conveying region of the centrifugal pump, and a shaft seal being provided which separates the region containing the conveying medium from the surrounding environment.

Pumps of this type comprise one or more stages which are usually arranged in a cylindrical housing. Such pumps are used, for example, as condensate pumps. The support bearing of such a pump is exposed primarily to an axial load, but the bearing also has to absorb radial forces. It has hitherto been customary to arrange the support bearing above the flow-carrying housing of the centrifugal pump, in a bearing housing separated from the flow-carrying housing. The support bearing either has been lubricated by grease or oil stored in the bearing housing, or the support bearing has been lubricated and, under certain circumstances, also cooled, by a separately provided medium, for example oil. This medium, which is conveyed under pressure, has thus been supplied to, and discharged from, the support bearing via respective lubricant pipelines. Since the drive shaft of the centrifugal pump has been extended through the bearing housing of the support bearing into the flow-carrying housing, i.e., the housing belonging to the conveying region of the centrifugal pump, it has been necessary to use three different shaft seals.

Above all, the expense involved in the version outlined in terms of the provision and the supply and discharge of a separate lubricant and coolant for the support bearing, but also the outlay in terms of the various shaft seals, have prompted the desire to provide a version which decisively reduces this outlay. The object on which the invention is based is founded on this desire.

SUMMARY OF THE INVENTION

It is an object of the present invention to provide an improved vertically arranged centrifugal pump with a support bearing which is provided above the pump and which absorbs the axial and radial forces exerted by the centrifugal pump and is lubricated by the pumped medium.

Another object of the present invention is to provide an improved centrifugal pump with a support bearing which is lubricated and, optionally, cooled by a medium conducted via the support bearing.

A further object of the invention is to provide a vertically arranged centrifugal pump having a support bearing arranged above the pump which minimizes the number of shaft seals required for the pump.

These and other objects are achieved in accordance with the present invention by providing a vertically arranged centrifugal pump comprising a flow-carrying housing sealed off in a leak-tight manner relative to the surrounding environment; the flow-carrying housing defining a suction zone and pressure zone; the pump having a support bearing provided above the pump for supporting a pump shaft; the support bearing comprising an axial bearing and a radial bearing and being surrounded by a bearing housing which directly adjoins the flow-carrying housing of the pump; the axial and radial bearings being lubricated by pumped medium of the centrifugal pump supplied to the bearing housing from the pressure zone of the pump through a gap formed by the radial bearing and then discharged from the bearing housing through a line leading to the suction zone of the pump, and the pump further comprising a shaft seal arranged on a side of the support bearing remote from the flow-carrying housing.

In accordance with the present invention, a vertically arranged centrifugal pump is provided having a support bearing arranged above the pump that absorbs the axial and radial forces exerted by the pump in which a) the support bearing is subdivided into an axial bearing and a radial bearing, b) the bearing housing surrounding the support bearing directly adjoins the housing belonging to the flow-carrying region of the centrifugal pump, c) the lubrication and, optionally, necessary cooling are performed by the pumped medium of the centrifugal pump, d) the pumped medium is supplied to the support bearing via a connection running from the pressure zone of the centrifugal pump and is discharged from the bearing housing into the suction zone of the centrifugal pump, e) the shaft seal is arranged on that side of the support bearing which faces away from the flow-carrying zones of the centrifugal pump.

The vertically arranged centrifugal pump according to the invention requires no extraneous medium for lubricating and cooling of the support bearing. This represents both a considerable cost saving and the elimination of a possible fault source. The direct joining of the support bearing housing to the flow-carrying housing makes it possible to reduce the overall length of the pump assembly.

It is considered highly advantageous if the axial bearing and the radial bearing are formed by plain bearings. This moreover makes it possible to connect the housing surrounding the support bearing to the flow-carrying region of the centrifugal pump via the gap formed by the radial bearing in order to supply the pumped medium to the support bearing via this gap to lubricate the bearing. This offers the advantage that, instead of the three shaft seals heretofore necessary, only one shaft seal is now required.

BRIEF DESCRIPTION OF THE DRAWINGS

The invention will be describe in further detail hereinafter with reference to illustrative preferred embodiments shown in the accompanying drawing figures, in which.

DETAILED DESCRIPTION OF PREFERRED EMBODIMENTS

Figure 1:
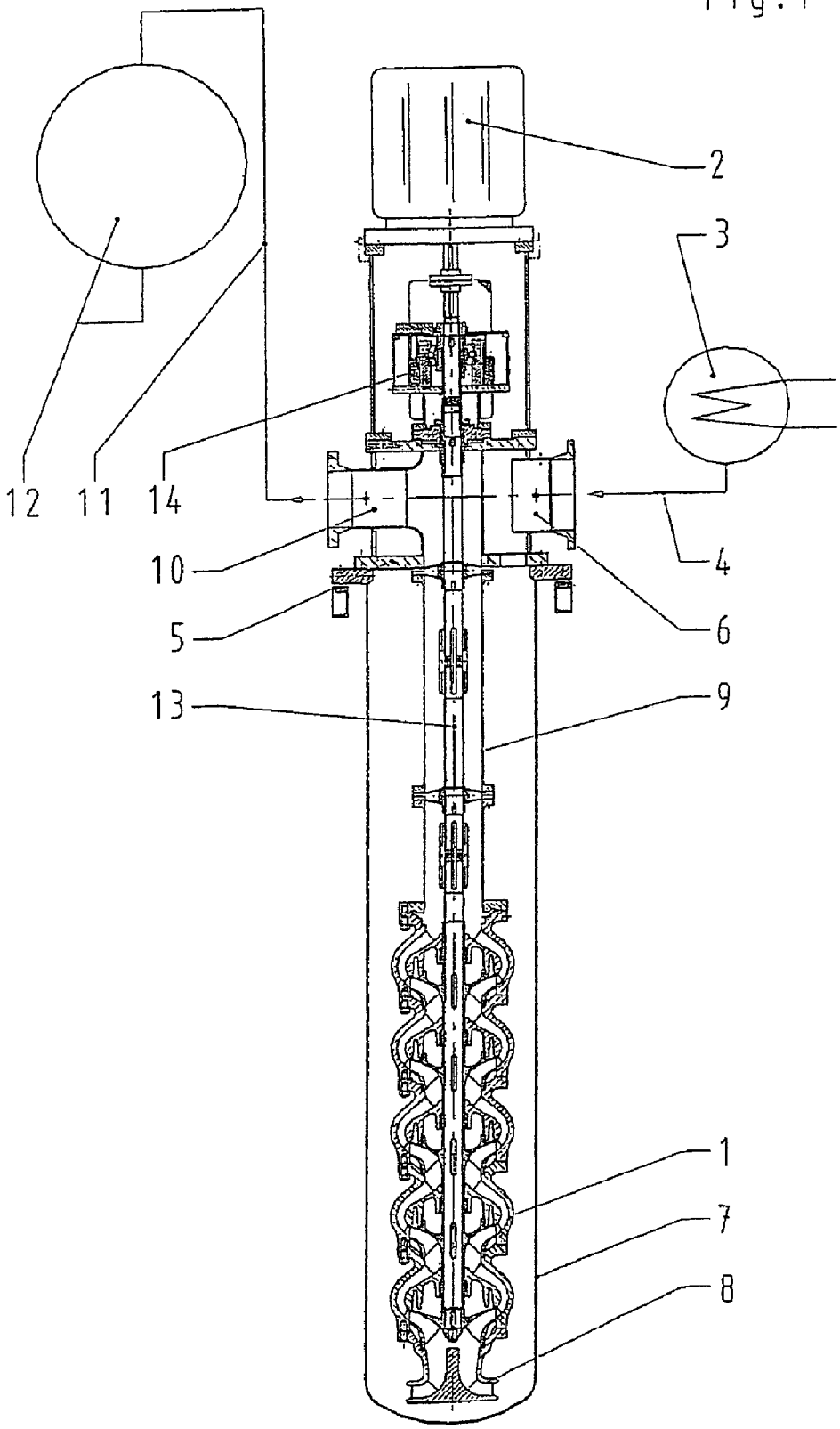
FIG. 1 is an illustration of part of a condensate and feed water circuit equipped with a vertically arranged centrifugal pump with a support bearing above the pump.

The cooling water circuit illustrated schematically in FIG. 1 is equipped with a centrifugal pump 1 driven by an electric motor 2. The centrifugal pump 1 has five stages. The medium to be conveyed by the pump which comes from a condenser 3 via a line 4 is guided via an inlet 6 arranged in an inlet/discharge housing 5, into a sump 7, from where it is sucked in via a pump inlet 8. The centrifugal pump 1 conveys the medium into a pressure pipe 9 and from thence via an outlet 10 and a line 11 to a feed water tank 12.

The centrifugal pump 1 is connected to the electric motor 2 by a drive shaft 13. The drive shaft 13, which carries the impellers of the centrifugal pump 1, is received in a support bearing 14.

Figure 2:
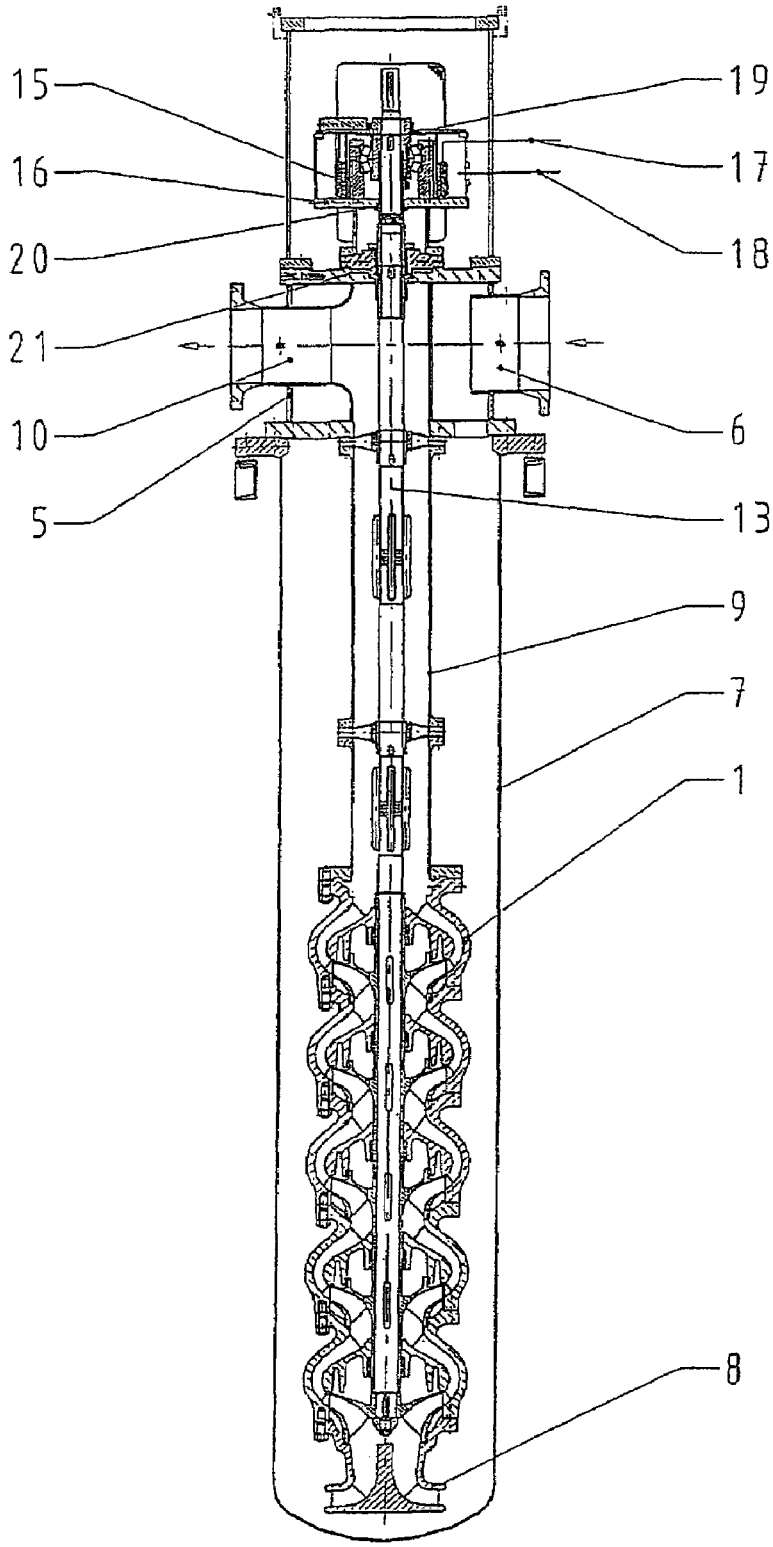
FIG. 2 is an illustration of a centrifugal pump equipped with a support bearing of the type known in the prior art.

The embodiment illustrated in FIG. 2 has a support bearing 15 which is constructed as a roller bearing which absorbs primarily axial forces, but also radial forces. The support bearing 15 is arranged in a housing 16. The support bearing 15 is supplied with lubricating and cooling medium via a connection 17. The lubricating and cooling medium is discharged again via a connection 18. In order to prevent an escape of the medium into the surrounding environment, shaft seals 19 and 20 are provided on the housing 16. The inlet/discharge housing 5 is sealed off by a shaft seal 21.

Figure 3:
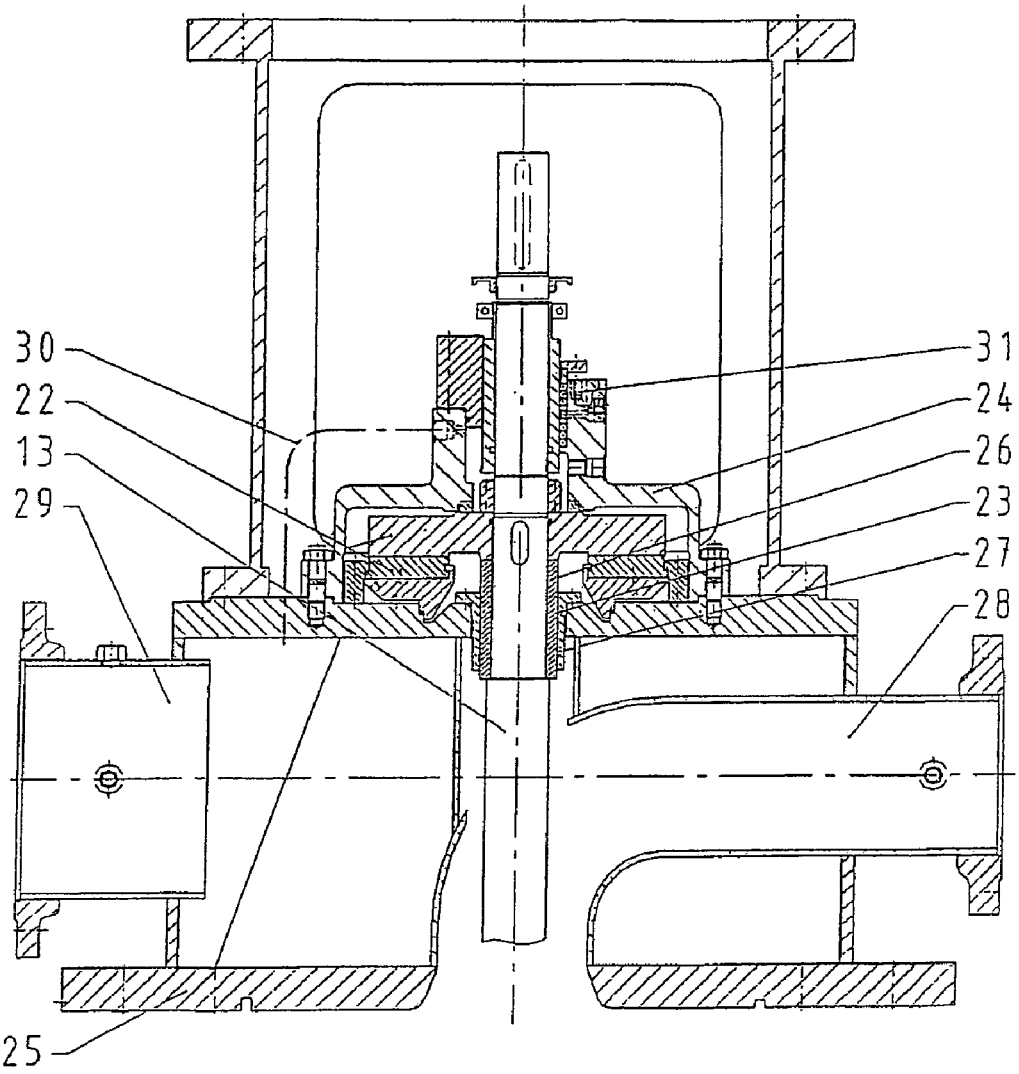
FIG. 3 is an illustration of the upper region of a centrifugal pump configured according to the present invention.

FIG. 3 shows an embodiment according to the invention. Here, the support bearing is formed from two plain bearings: an axial bearing 22 and a radial bearing 23. The support bearing is surrounded by a housing 24 which is placed directly onto the flow-carrying inlet/discharge housing 25. Pumped medium passes from the pressure zone 28 into the interior of the bearing housing 24 via the gap which is formed between the bearing shell 26 and the bush 27 of the radial bearing 23. The pumped medium thus lubricates both the radial bearing 23 and the axial bearing 22. A lubricant return line 30 which opens into the suction zone in the inlet 29 serves to discharge the pumped lubricating medium from the housing 24. The pumped medium thus flows constantly through the bearing housing 24, and the axial bearing 22 and radial bearing 23 are therefore also cooled, without being exposed. There is therefore no need for an external lubricating and cooling medium, for an external lubricant pressure source, or for an external cooling device for the lubricating medium.

In contrast to the prior art device shown in FIG. 2, the embodiment according to the invention illustrated in FIG. 3 requires only a single shaft seal 31 at the point where the drive shaft 13 exits from the bearing housing 24 into the surrounding environment. This not only result in cost savings during manufacture, but also eliminates potential failure sites.

An additional advantage which may also be mentioned is that the arrangement of the present invention is shorter in length than the configuration of the prior art shown in FIG. 2.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A vertically arranged centrifugal pump comprising a flow-carrying housing sealed off in a leak-tight manner relative to the surrounding environment; said flow-carrying housing defining a suction zone and pressure zone; said pump having a support bearing provided above the pump for supporting a pump shaft; said support bearing comprising an axial bearing and a radial bearing and being surrounded by a bearing housing which directly adjoins the flow-carrying housing of the pump; said axial and radial bearings being lubricated by pumped medium of the centrifugal pump supplied to the bearing housing from the pressure zone of the pump through a gap formed by the radial bearing and then discharged from the bearing housing through a line leading to the suction zone of the pump, and said pump further comprising a shaft seal arranged on a side of the support bearing remote from said flow-carrying housing.

2. A centrifugal pump according to claim 1, wherein the axial bearing and the radial bearing are plain bearings.

3. A centrifugal pump according to claim 1, wherein the radial bearing is cooled by the pumped medium.

* * * * *